US006981680B1

(12) United States Patent
Gordon et al.

(10) Patent No.: US 6,981,680 B1
(45) Date of Patent: Jan. 3, 2006

(54) TENT LEG WEIGHTS

(75) Inventors: Cindy S. Gordon, 10138 SE. Vandalia, Runnells, IA (US) 50237-2068; Clarence H. Rail, Ankeny, IA (US); Clyde T. Rail, Ankeny, IA (US)

(73) Assignee: Cindy S. Gordon, Runnells, IA (US)

( * ) Notice: Subject to any disclaimer, the term of this patent is extended or adjusted under 35 U.S.C. 154(b) by 0 days.

(21) Appl. No.: 10/861,259

(22) Filed: Jun. 4, 2004

(51) Int. Cl.
*A47B 91/00* (2006.01)

(52) U.S. Cl. ..... 248/346.01; 135/118; 248/346.05; 248/910

(58) Field of Classification Search ..... 248/346.01, 248/346.03, 346.05, 508, 519, 538, 188.4, 248/188.2, 511, 910; 135/118
See application file for complete search history.

(56) References Cited

U.S. PATENT DOCUMENTS

| | | | | |
|---|---|---|---|---|
| 2,890,545 | A * | 6/1959 | Fiddler | 248/188.4 |
| 4,161,131 | A * | 7/1979 | Blayman | 84/453 |
| 4,782,846 | A | 11/1988 | Ting | |
| 5,354,031 | A | 10/1994 | Bilotti | |
| 5,615,699 | A | 4/1997 | Lee | |
| 5,706,531 | A | 1/1998 | Aubertine | |
| 6,092,342 | A | 7/2000 | Sharapata | |
| 6,113,054 | A | 9/2000 | Ma | |
| 6,269,825 | B1 | 8/2001 | Yager | |
| 6,305,659 | B1 * | 10/2001 | Metelski | 248/519 |
| 6,619,610 | B1 * | 9/2003 | Genovese | 248/519 |
| D484,303 | S | 12/2003 | Taylor | |
| 2002/0174887 | A1 | 11/2002 | Reese | |
| 2004/0011941 | A1 * | 1/2004 | Roepke et al. | 248/519 |

* cited by examiner

*Primary Examiner*—Ramon O Ramirez
(74) *Attorney, Agent, or Firm*—McKee, Voorhees & Sease, P.L.C.

(57) ABSTRACT

Weights are provided for the legs of tents or display stands to stabilize the tents or stands. Each weight comprises one or more plates which may be stacked upon one another and secured by fasteners extending through aligned holes in the plates. Additional holes in the plates are adapted to receive another fastener extending through a foot on the leg to secure the leg to the weight. The weights may include leveling legs on the bottom plate to accommodate uneven or sloped terrain. Carrying handles are attached or formed in the plates. The weights are flat and provide a low profile to prevent accidental tripping over the weights and to minimize storage and transportation space of the weights.

25 Claims, 5 Drawing Sheets

TENT LEG WEIGHTS

BACKGROUND OF THE INVENTION

Tents are often utilized at trade shows, such as art and craft shows, at an exhibitor's booth. Tents are also used at track and cross country meets for a team's gathering site and shelter. The tents generally include four legs with an upper frame work to support a fabric cover. The fabric sidewalls may also be provided for the tent. At outdoor craft shows, the tent legs must be weighted or staked to the ground to secure the tent against winds. Such weight is typically provided by bulky, concrete blocks or large PVC pipe filled with concrete or sandbags, all of which present hazards to people around the tent due to their bulky size. Also, such blocks and pipes are difficult or awkward to carry and handle, and take up substantial space during transport or storage due to their bulky size.

Similarly, display stands used at trade shows without an overhead covering have legs which often times must be weighted or staked to the ground for stability. However, some shows are held on pavement, such as parking lots, which does not permit the use of stakes. The bulky concrete blocks, concrete-filled PVC tubes and sandbags are also commonly used for such display stands, similar to the craft show tents.

The bulky size, awkwardness, and safety hazards presented by conventional weights for tent legs or display stand legs create numerous problems which would preferably be avoided.

Accordingly, a primary objective of the present invention is the provision of an improved weight for the leg of a tent or a display stand.

Another objective of the present invention is the provision of a weight for a tent leg or display stand leg which is flat so as to minimize risk of tripping by people standing near the leg.

A further objective of the present invention is the provision of a weight for tent and display stand legs comprising one or more steel plates which can be stacked and secured together, as needed.

Still another objective of the present invention is the provision of an improved weight for tent legs and display stand legs which includes a handle for easy carrying of the weight.

Yet another objective of the present invention is the provision of an improved weight for tent and display stand legs which allow the legs to be quickly and easily secured to the weight.

Another objective of the present invention is the provision of a weight for tent and display stand legs which includes adjustable leveling legs to accommodate uneven terrain.

A further objective of the present invention is the provision of a weight for tent and display stand legs that is compact for transport and storage.

Another objective of the present invention is the provision of a weight for tent legs and display stand legs wherein the weight comprises a plate having at least one contoured edge which is adapted to matingly nest with a similar edge on a second plate so as to minimize movement of the plates during transport.

A further objective of the present invention is the provision of an improved weight for legs of tents and display stands which is economical to manufacture, simple and safe to use, and durable in use.

These and other objectives will become apparent from the following description of the invention.

SUMMARY OF THE INVENTION

The weight of the present invention for a tent or display stand leg comprises one or more flat, steel plates. Multiple plates may be secured together with fasteners to provide a set of plates. Each plate includes one or more apertures. A fastener is adapted to engage or extend through the foot on the bottom of the leg and into the upper plate aperture to releasably secure the leg to the plate. Preferably, each plate, or at least one of the plates in each set of secured plates, includes a handle for carrying the plate or assembled plates. A stake for staking the weight to the ground to prevent movement of the weight may extend through the handle pocket or through a stake hole in the plate. Adjustable leveling legs may be provided on the plate to accommodate uneven ground or pavement. Each plate includes a cut out portion. In one embodiment, a handle is welded to the plate so as to extend across the cut out portion. In another embodiment, the cut out portion defines integrally formed handle, which is adapted to matingly nest within the cut out portion of an adjacent plate.

DETAILED DESCRIPTION OF THE DRAWINGS

Figure 1:
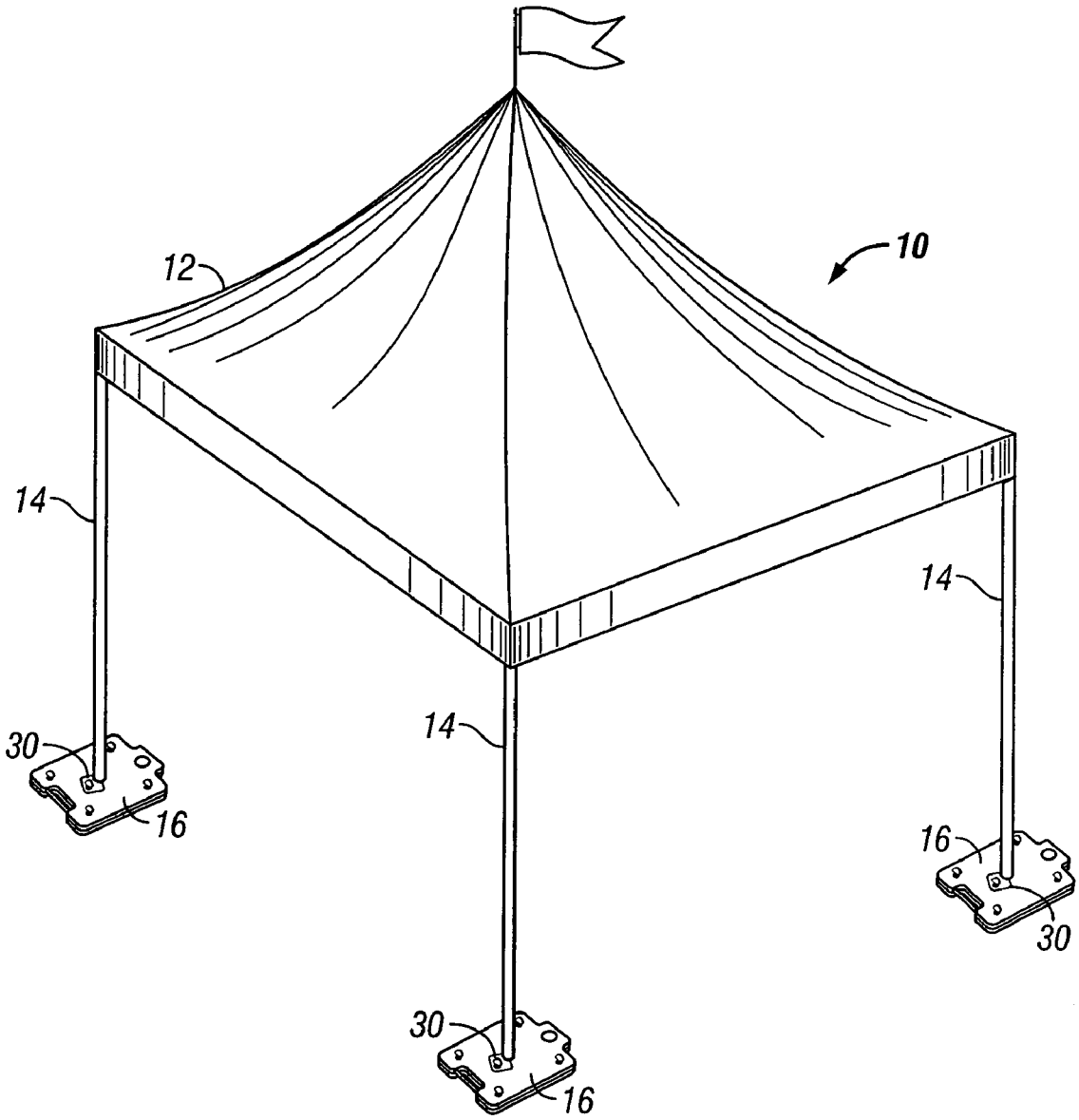
FIG. 1 is a perspective view of a tent having legs secured to one embodiment of the weights of the present invention.
Figure 2:
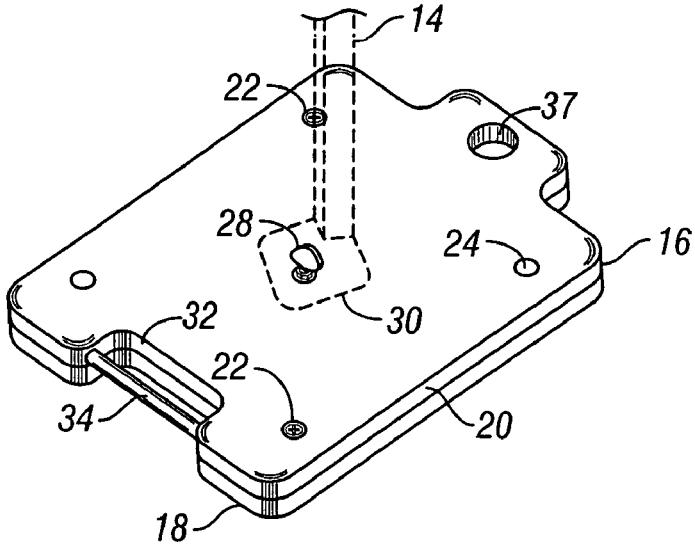
FIG. 2 is an enlarged perspective view of one of the weights shown in FIG. 1.
Figure 3:
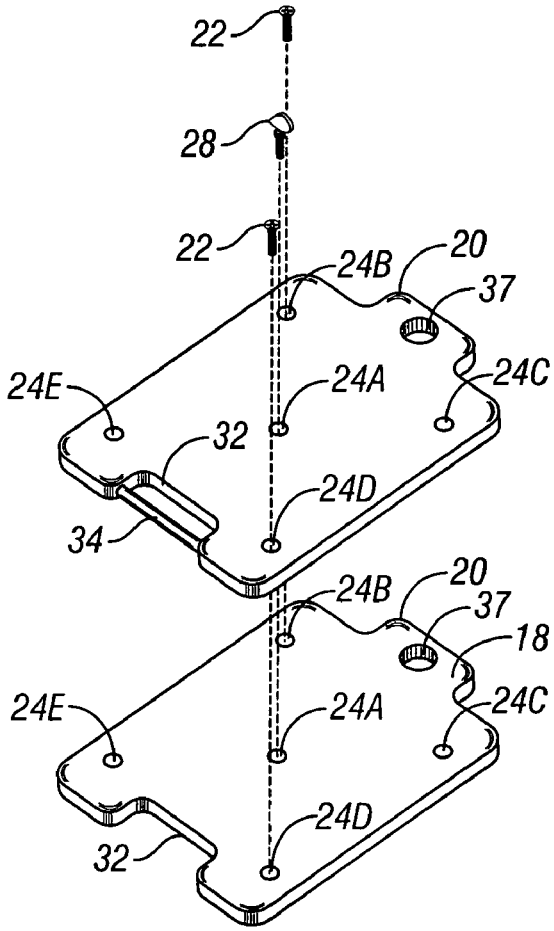
FIG. 3 is an exploded perspective view of the weight of FIG. 2.

FIG. 1 shows a tent 10 having a canopy 12 supported by legs 14. Each of the legs 14 of the tent 10 are secured to a weight 16 of the present invention. FIGS. 1–4 show a first embodiment of the weight 16. The weight includes a pair of flat plates 18, 20 which are secured together by fasteners 22. Alternately, the plates 18, 20 may be welded together. Each plate 18, 20 include holes 24A–E. Preferably, the fasteners 22 are flat headed bolts threadably received within holes 24 in each of the plates 18, 20. The heads of the fasteners 22 are preferably counter-sunk in the plate 20, as best seen in FIG. 2. Two or more fasteners 22 are used to secure the plates 18, 20 together.

Another fastener 28, such as a thumb screw, is adapted to extend through a tent foot 30 connected to the leg 14 and into one of the holes 24A–E. For example, as shown in the drawings, the fastener 28 is received in the center hole 24A such that the leg 14 is approximately centered on the weight 16. It is understood that the fastener 28 may be secured in any of the holes 24A–E to secure the leg 14 to the weight 16.

The weight 16 is provided with a cut out portion 32 across which a handle 34 extends. Preferably, the plates 18, 20 are made from steel, and the handle 34 is made from steel so as to be weldable to the sides of the cut out portion 32 or to the ends of one of the plates 18, 20 adjacent the cut out portion 32. The handle may be covered, such as coated with plastic or wrapped with grip tape, for thermal insulation and safety, since the steel handle 34 tends to become hot when the weight 16 is used outdoors in the sun.

While holes 24A–E and fasteners 22, 28 are preferably threaded, it is understood that other types of fasteners may be utilized, such as an expandable weld nut, which does not utilize threads.

Figure 4:
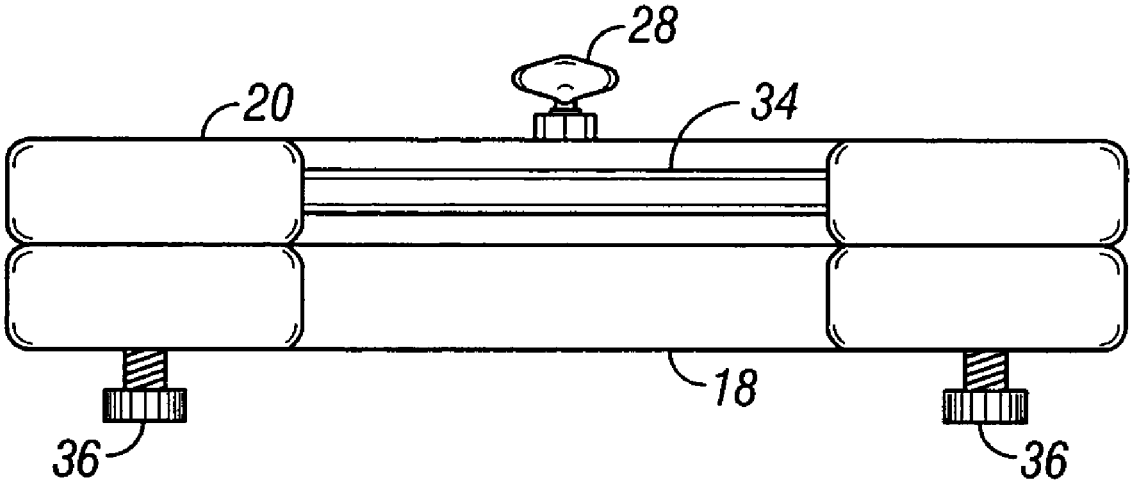
FIG. 4 is a side elevation view of the weight of FIG. 2.

As shown in FIG. 4, adjustable leveling legs 36 may be provided so that the weight 16 can be used on sloped or uneven ground, with the leveling legs 36 being threaded into any one of the holes 24B–E on the bottom of the lower plate 18.

The plates 18, 20 may include an enlarged hole 37 adapted to receive a stake (not shown) for insertion into the ground, if desired by a user. Alternatively, a stake can be placed over the handle 34 to secure the weight 16 to the ground or asphalt.

Figure 5:
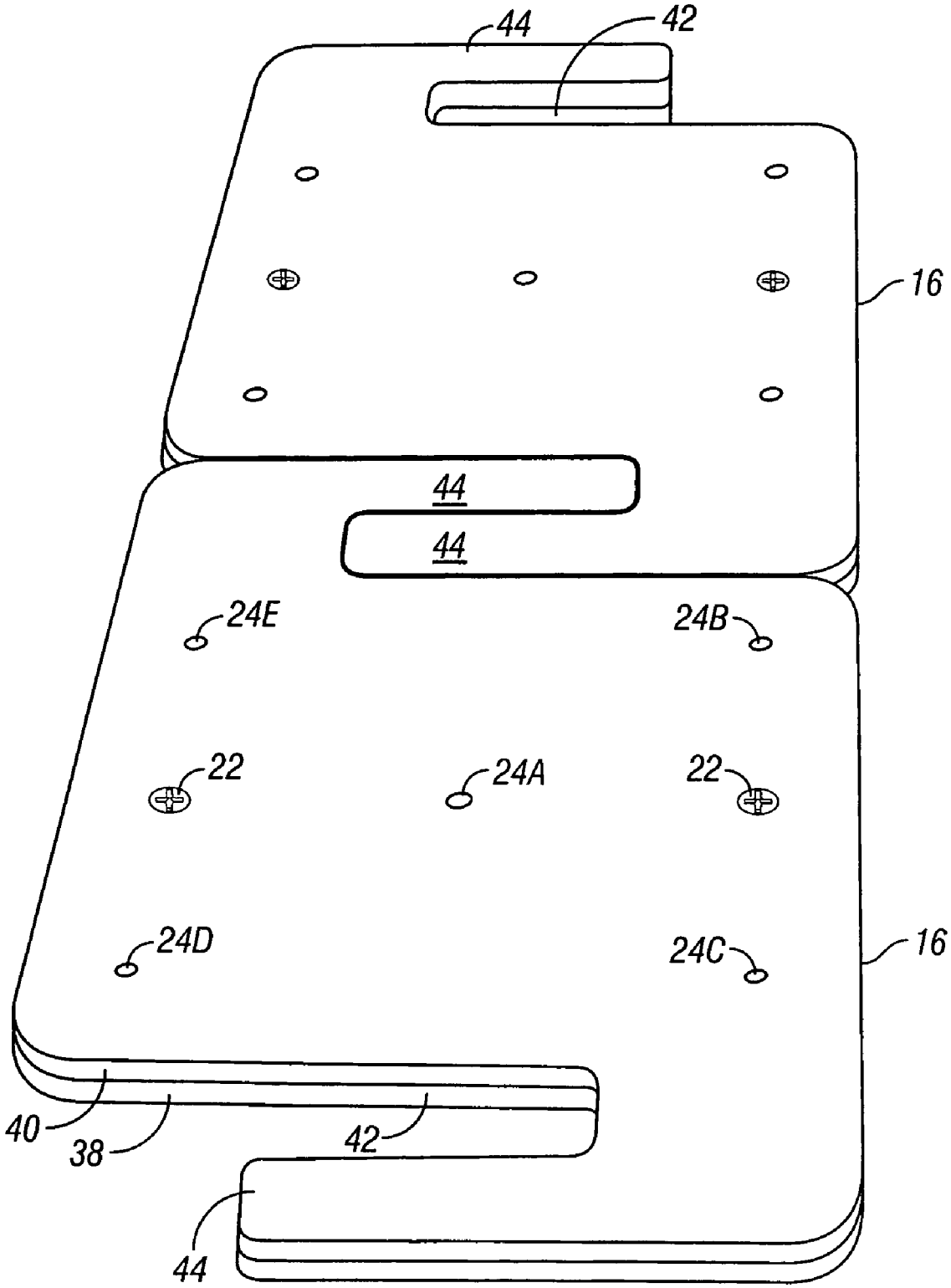
FIG. 5 is a perspective view of an alternative embodiment of the weight and showing two weights nested together for transportation.
Figure 6:
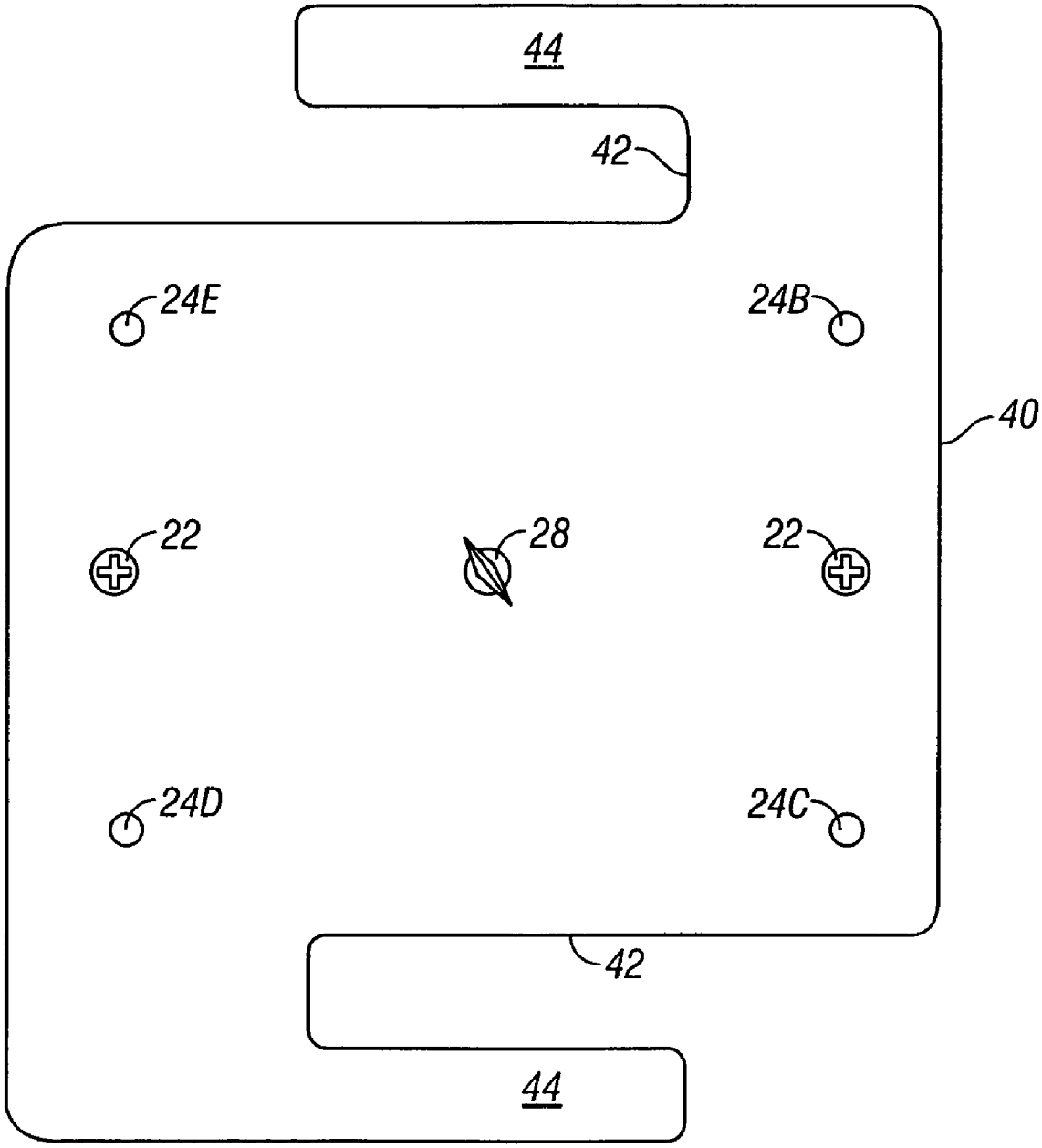
FIG. 6 is a top plan view of one of the weights shown in FIG. 5

A second embodiment of the weight 16 is shown in FIGS. 5 and 6. In this embodiment, each plate 38, 40 is provided with holes, for receiving the fasteners 22 to secure multiple plates together, and holes 24A–E for receiving a fastener, similar to fastener 28, for securing the foot 30 of the leg 14 to the upper plate 40. The plates 38, 40 include cut out portions 42 which form handles 44 at the ends of the plates. Pairs of plates may be positioned end to end, as seen in FIG. 5, such that the handles 44 of one weight 16 nests within the cut out portion 42 of an adjacent weight 16. Such nesting arrangement of the weights 16 minimize storage and transport area and help minimize sliding of the weights 16 during transportation.

While the drawings show two plates 18, 20 or 38, 40 secured together, it is understood that a single plate may be used as the weight 16, or three or more plates secured together for the weight 16. The number of plates to be used depends upon the weight of the individual plates and upon the wind conditions in which the tent or display stand may be subjected.

The weight 16 provides a flat profile which minimizes the risk of tripping people standing near the legs 14. The flat profile of the weights 16 also minimizes storage space for the weights.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A weight for a tent or display stand having a leg with a foot, comprising:

a flat lower plate;

a flat upper plate releasably secured to the lower plate and having at least one aperture therein; and a fastener adapted to extend downwardly through the foot and extend downwardly into the upper plate aperture to releasably secure the tent leg to the upper plate.

2. The weight of claim 1 wherein the upper plate has a plurality of apertures for receipt of the fastener in one of the apertures.

3. The weight of claim 1 wherein the aperture and fastener each include threads for threadable mating.

4. The weight of claim 1 wherein the lower and upper plates are secured together with screws.

5. The weight of claim 1 wherein one of the plates includes a handle.

6. The weight of claim 5 wherein at least one of the plates has a cut out portion and the handle extends across the cut out portion.

7. The weight of claim 5 wherein the handle is formed by a cut out portion in the one plate.

8. The weight of claim 1 wherein each plate includes a handle formed by a cut out in the plates.

9. The weight of claim 8 wherein the handle of one plate nests within the cut out portion of the other plate when the plates are placed side-by-side.

10. The weight of claim 1 wherein each plate has an opening for receiving a stake.

11. The weight of claim 1 wherein the lower plate has adjustable leveling legs.

12. The weight of claim 1 wherein each of the plates has at least one contoured edge adapted to matingly nest with a contoured edge of an adjacent plate identical to the lower and upper plates.

13. A weight for a tent or display stand leg having a foot, comprising:

a first plate having a plurality of apertures;

a handle formed by a cut out in the plate; and a fastener adapted to extend through a hole in the foot and into one of the apertures so as to releasably secure the leg to the plate.

14. The weight of claim 13 wherein the plate includes a contoured edge adapted to matingly nest with a contoured edge of a second identical plate.

15. The weight of claim 13 wherein the apertures and fastener are threaded for threadable mating.

16. The weight of claim 13 further comprising a second flat plate releasably secured to the first plate to provide additional weight.

17. The weight of claim 16 wherein the plates are secured with screws.

18. The weight of claim 13 further comprising adjustable leveling legs on the plate.

19. The weight of claim 13 further comprising a second plate with a handle formed by a cut out in the second plate, the handles of the first and second plates matingly nesting together when the plates are placed side-by-side.

20. The weight of claim 13 wherein the plate has an opening for receiving a stake.

21. A weight for a tent or display stand leg having a foot, comprising:

a first plate having a hole;

a cut out portion in the plate;

a handle extending across the cut out portion;

a fastener adapted to extend through a hole in the foot and into the hole in the plate to secure the leg to the plate.

22. The weight of claim 21 wherein a second plate is secured to the first plate for additional weight.

23. The weight of claim 21 wherein the hole in the plate is threaded and the fastener is a thumb screw.

24. A weight for a tent or display stand having a leg with a foot, comprising:

a lower plate;

upper plate releasably secured to the lower plate and having at least one aperture therein;

a fastener adapted to engage the foot and extend into the upper plate aperture to releasably secure the tent leg to the upper plate; and wherein each plate has an opening for receiving a stake.

25. A weight for a tent or display stand having a leg with a foot, comprising:

a lower plate;

upper plate releasably secured to the lower plate and having at least one aperture therein;

a fastener adapted to engage the foot and extend into the upper plate aperture to releasably secure the tent leg to the upper plate; and wherein each of the plates has at least one contoured edge adapted to matingly nest with a contoured edge of an adjacent plate identical to the lower and upper plates.

* * * * *